US012702934B2

(12) United States Patent
Harrington et al.

(10) Patent No.: US 12,702,934 B2
(45) Date of Patent: Aug. 11, 2026

(54) RIDE SYSTEM WITH VEHICLE SUPPORT FOR SUSPENSION AND FLOATING OPERATION

(71) Applicant: Universal City Studios LLC, Universal City, CA (US)

(72) Inventors: Sarka Harrington, Orlando, FL (US); Eric Alan Vance, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 566 days.

(21) Appl. No.: 17/307,707

(22) Filed: May 4, 2021

(65) Prior Publication Data

US 2021/0346814 A1 Nov. 11, 2021

Related U.S. Application Data

(60) Provisional application No. 63/020,210, filed on May 5, 2020.

(51) Int. Cl.

| | |
|---|---|
| ***A63G 31/00*** | (2006.01) |
| ***A63G 7/00*** | (2006.01) |
| ***A63G 21/04*** | (2006.01) |
| ***A63G 21/20*** | (2006.01) |

(52) U.S. Cl.

CPC ..... *A63G 31/007* (2013.01); *A63G 7/00* (2013.01); *A63G 21/04* (2013.01); *A63G 21/20* (2013.01)

(58) Field of Classification Search

CPC ..... A63G 31/007; A63G 7/00; A63G 21/04; A63G 21/20; A63G 1/00; A63G 3/00; A63G 3/02

USPC ..... 104/53

See application file for complete search history.

(56) References Cited

U.S. PATENT DOCUMENTS

| | | | |
|---|---|---|---|
| 3,003,430 | A | 10/1961 | Hamel |
| 6,810,817 | B1 | 11/2004 | James |
| 7,437,998 | B2 | 10/2008 | Burger et al. |
| 8,079,916 | B2 | 12/2011 | Henry |
| 8,091,483 | B1 | 1/2012 | Sumner |
| 8,393,275 | B2 | 3/2013 | Jacobi et al. |

(Continued)

FOREIGN PATENT DOCUMENTS

| | | | |
|---|---|---|---|
| CN | 202063248 | U | 12/2011 |
| CN | 107776837 | A | 3/2018 |

(Continued)

OTHER PUBLICATIONS

PCT/US2019/054506 International Search Report and Written Opinion Jan. 28, 2020.

(Continued)

*Primary Examiner* — S. Joseph Morano
*Assistant Examiner* — Heaven R Buffington
(74) *Attorney, Agent, or Firm* — Fletcher Yoder, P.C.

(57) ABSTRACT

A ride system includes a ride vehicle made of a buoyant material configured to float in a liquid. A bogie of the ride system includes a vehicle support positioned under the ride vehicle, and the bogie is configured to travel along a track. An extender is coupled to the vehicle support and coupled to the ride vehicle. The extender is configured to transition between a retracted configuration and an extended configuration to allow the ride vehicle to float in the liquid within a range of motion relative to the vehicle support.

20 Claims, 7 Drawing Sheets

(56) References Cited

U.S. PATENT DOCUMENTS

| | | | | |
|---|---|---|---|---|
| 8,453,579 | B2 | 6/2013 | Nemeth | |
| 8,641,540 | B2 * | 2/2014 | Feuer | A63G 7/00 472/43 |
| 2009/0193997 | A1 | 8/2009 | Payne | |
| 2010/0160054 | A1 | 6/2010 | Henry | |
| 2020/0101390 | A1 | 4/2020 | McCormick | |
| 2020/0108324 | A1 | 4/2020 | Bloomfield et al. | |

FOREIGN PATENT DOCUMENTS

| | | | |
|---|---|---|---|
| CN | 109395402 | A | 3/2019 |
| JP | H0724397 | U | 5/1995 |
| JP | H0852277 | A | 2/1996 |
| JP | 3039760 | U | 7/1997 |
| JP | 2000093659 | A | 4/2000 |
| NL | 1009494 | C2 | 1/2000 |

OTHER PUBLICATIONS

PCT/US2021/030920 Invitation to Pay Additional Fees mailed Aug. 30, 2021.
JP Office Action for Japanese Application No. 2022-566694 mailed Dec. 17, 2024.
JP Office Action for Japanese Application No. 2022-566694 mailed Apr. 17, 2025.
SG Office Action for Singapore Application No. 11202253900C mailed Mar. 27, 2025.

* cited by examiner

RIDE SYSTEM WITH VEHICLE SUPPORT FOR SUSPENSION AND FLOATING OPERATION

CROSS-REFERENCE TO RELATED APPLICATION

The present disclosure claims priority to and the benefit of U.S. Provisional Application No. 63/020,210, entitled "RIDE SYSTEM WITH VEHICLE SUPPORT FOR SUSPENSION AND FLOATING OPERATION," filed on May 5, 2020, the disclosure of which is incorporated by reference for all purposes.

BACKGROUND

The present disclosure relates generally to the field of amusement parks. More specifically, embodiments of the present disclosure relate to methods and equipment used in conjunction with amusement park rides.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Since the early twentieth century, amusement parks (or theme parks) have substantially grown in popularity. Certain amusement park rides may include a water ride configured to carry riders only along a water path. Other amusement park rides may include a roller coaster ride configured to carry riders only along a track with a bogie. However, these single-environment riding formats may unintentionally limit an experience of a rider. Accordingly, it is now recognized that an improved amusement park ride having multiple transportation modes may be desirable to enhance guest experience.

SUMMARY

Certain embodiments commensurate in scope with the originally claimed subject matter are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

In accordance with an embodiment, a ride system includes a ride vehicle made of a buoyant material configured to float in a liquid. A bogie of the ride system includes a vehicle support positioned under the ride vehicle, and the bogie is configured to travel along a track. An extender is coupled to the vehicle support and coupled to the ride vehicle. The extender is configured to transition between a retracted configuration and an extended configuration to allow the ride vehicle to float in the liquid within a range of motion relative to the vehicle support.

In accordance with an embodiment, a ride system includes a ride path including an aerial portion and an aquatic portion. A track of the ride system extends along the path and a bogie is configured to engage with and travel along the track. Additionally, a ride vehicle of the ride system is configured to transport riders, and a vehicle support of the bogie is positioned under the ride vehicle and configured to support the ride vehicle through the aerial portion of the ride path. Moreover, an extender couples the ride vehicle to the vehicle support. The extender is configured to retract and secure the ride vehicle to the vehicle support through the aerial portion of the ride path. Additionally, the extender is configured to extend and retract in response to buoyancy of the ride vehicle positioned within a liquid through the aquatic portion of the ride path.

In accordance with an embodiment, a method of ride system operation includes positioning a ride vehicle into a body of liquid using a bogie coupled to the ride vehicle via a ride vehicle support, which is coupled to the ride vehicle via an extender. The method further includes transitioning the extender from a retracted configuration to an extended configuration as the ride vehicle becomes buoyant in the liquid. Additionally, the method includes allowing the ride vehicle to move within a motion envelope defined by the retracted configuration and the extended configuration as the ride vehicle experiences buoyant forces in the liquid.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
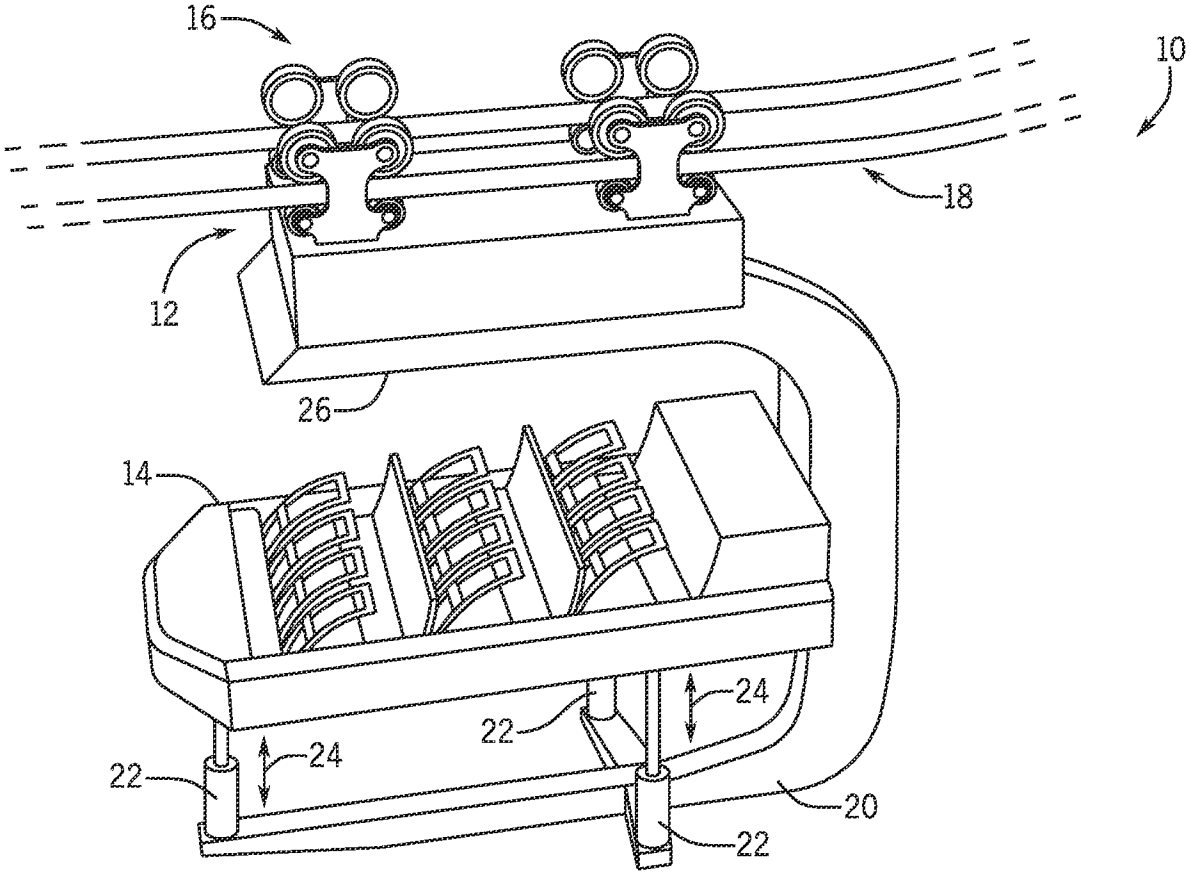
FIG. 1 is a perspective view of an embodiment of a ride system, in accordance with the present disclosure.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure provides, among other things, embodiments of a ride system having both an aquatic portion and an aerial portion, where each portion corresponds to a different mode of vehicle operation. For example, the ride system may include a ride vehicle that functions as a boat to float along a water flow path of the aquatic portion, as well as a roller coaster to move along an aerial track of the aerial portion. Generally, amusement park ride attractions either include a boat configured to float along a waterway or a coaster configured to move along a track, but not both. However, the singular and sometimes predictable ride formats of these attractions may limit rider enjoyment. Some amusement park rides aim to further engage riders by utilizing a ride vehicle that moves along a track, where the track may include an aerial portion and a submerged portion. However, simply transitioning from between an aerial track and a submerged track may unintentionally limit ride experiences. Indeed, since the ride vehicle is confined to the submerged track while in the submerged portion, a rider does not experience a full buoyed floating effect associated with being in an actual boat. In reality, a result of the confined ride vehicle may be a slow and predictable roller coaster that may be in contact with water. Accordingly, provided herein is a ride attraction that includes one or more transitions between riding formats, including an aerial (or suspended) portion and an aquatic (or buoyant) portion in which an enjoyable buoyancy of the ride vehicle is experienced. In certain embodiments, each riding format may be separate and distinct, such that the transition between riding formats is unexpected. Indeed, in accordance with present embodiments, each transition between riding formats serves to surprise and increase a level of entertainment of the rider.

Particularly, embodiments of the present disclosure include a ride vehicle configured to float on water (which is representative of any manner of fluid or liquid) while remaining coupled to a vehicle support of a bogie, which in turn is coupled to a ride track. Specifically, the ride vehicle may be coupled to the vehicle support via extenders (e.g., pistons) that allow the vehicle to float (e.g., be submersed) while the extenders are at least partially submerged in water. As used herein, submerged components generally refer to components positioned completely underneath a top surface of the water, while submersed or partially submerged components generally refer to components having at least a portion thereof that is underneath the top surface, such that the components may be floating on and/or within the top surface. This configuration allows the ride vehicle to readily transition between an aerial portion and an aquatic portion of a ride system. For example, while the ride vehicle is floating on the aquatic portion of the ride, the rider may be unaware of an upcoming change in ride format to a suspended or aerial portion. Indeed, the bogie (and its connection to the ride vehicle) may be camouflaged, enabling the ride vehicle to generally appear to the riders as a boat that is not capable of transitioning to an aerial ride format. However, once the ride vehicle exits the water, the extenders may collapse to enable the ride vehicle to interface with the vehicle support of the bogie in a manner that secures the ride vehicle to the bogie for the aerial portion of the ride. In some embodiments, this interfacing may include actuation of a locking feature (e.g., a hydraulic latch, pulling down of a hydraulic actuator) that secures the ride vehicle to the vehicle support. Once the ride vehicle seamlessly couples to the bogie, the bogie may carry the ride vehicle along the ride track while pitching, yawing, and/or rolling the ride vehicle, thereby further enhancing a thrill factor for the rider. It should be noted that transitions between aerial and aquatic ride portions may occur in either direction, in accordance with present embodiments and in a manner that is thrilling to riders. In some embodiments, the ride vehicle may even pass along (or be made to appear to pass along) physical tracks beneath the ride vehicle to further confuse and thrill riders as they transition to visually identifiable aerial portions and/or aquatic portions of the ride system.

FIG. 1 is a perspective view of a ride system 10, which includes a bogie 12 and a ride vehicle 14. As shown, the bogie 12 includes a wheel assembly 16 configured to couple to a track 18. Further, the bogie 12 includes a vehicle support 20 (e.g., yoke, armature), which couples to the ride vehicle 14 via extenders 22. The extenders 22, which may include pistons, actuators (e.g., hydraulic, electric), airbags, or any other suitable height-adjustable mechanisms, operate to allow the ride vehicle 14 to move relative to the vehicle support 20 with multiple degrees of freedom. For example, the extenders 22 may extend and contract to reach different lengths (as represented by arrows 24), such that the ride vehicle 14 moves in a natural way in response to buoyancy. Indeed, when the ride vehicle 14 is positioned in water, buoyant forces may apply differently at the various locations along the ride vehicle 14 of the extenders 22, and the extenders 22 may adjust (e.g., extend or contract) accordingly. In this way, riders can be made to feel as though the ride vehicle 14 is floating freely on water while, in actuality, the ride vehicle 14 remains secured to the bogie 12 via the extenders 22. In some embodiments, the ride system 10 may incorporate an overhead structure 26 (e.g., a canopy), which may serve to obstruct the riders' view of the wheel assembly 16 and other elements of the bogie 12, thereby further contributing to an immersive experience of the riders. That is, riders may be made to feel as though they are in a boat that is fully being controlled by forces associated with the water (e.g., buoyancy). The ride vehicle 14 may be formed of any suitable material configured to contribute to the buoyancy of the ride vehicle 14 and establish a suitable metacenter that is above a center of gravity of the ride vehicle 14. Further, it should be noted that the shape of the ride vehicle 14 should not be limited to the illustrated embodiments. For example, in some embodiments, the ride vehicle 14 may be in the shape of a sail boat, which may carry any suitable number of riders.

Figure 2:
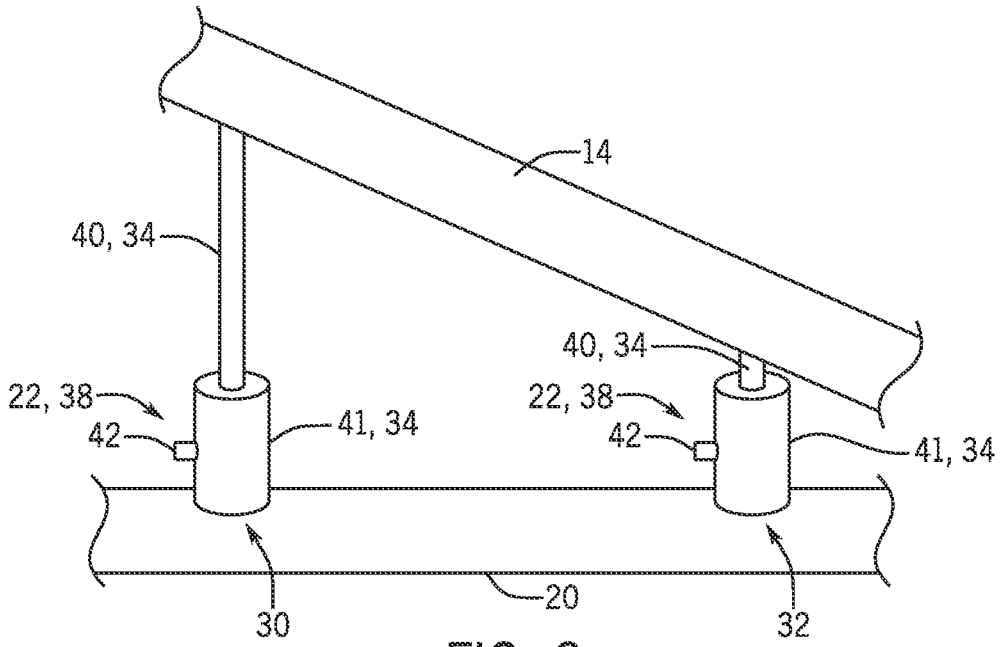
FIG. 2 is a schematic perspective view of extenders coupling a ride vehicle to a vehicle support, in accordance with the present disclosure.
Figure 3:
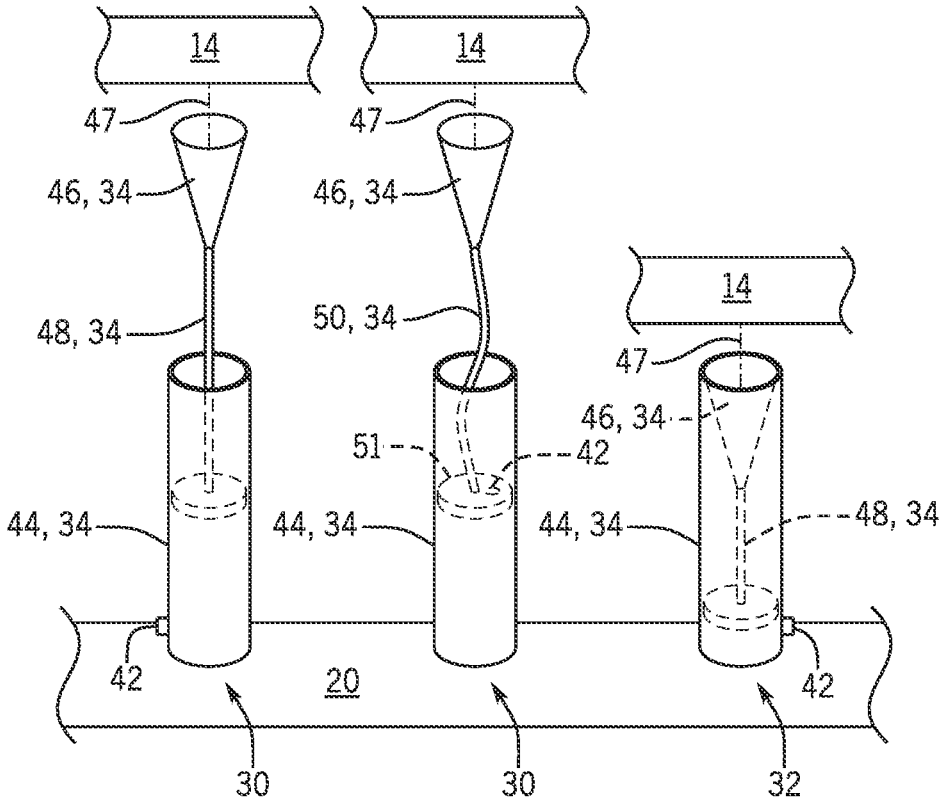
FIG. 3 is a schematic perspective view of extenders coupling the ride vehicle to the vehicle support, in accordance with the present disclosure.
Figure 4:
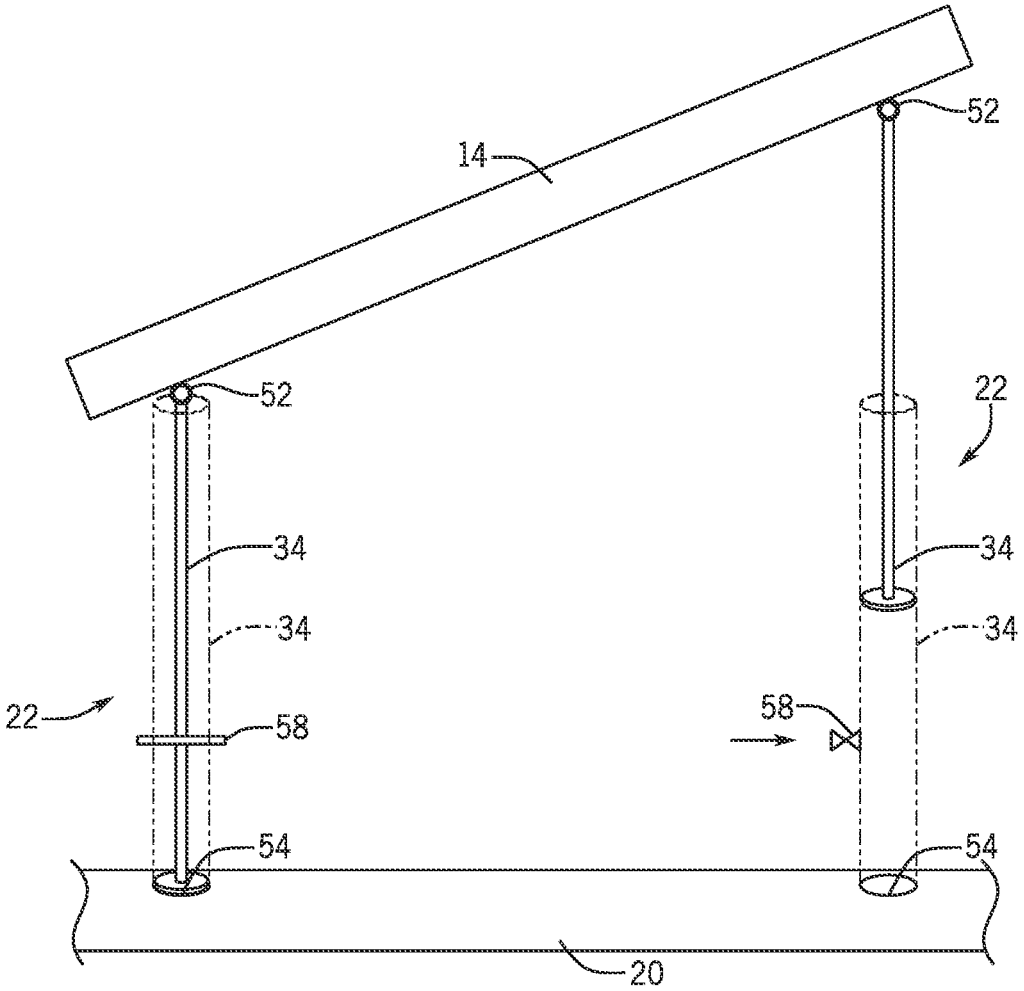
FIG. 4 is a schematic perspective view of extenders coupling the ride vehicle to the vehicle support, illustrating locking features of the extenders, in accordance with the present disclosure.
Figure 5:
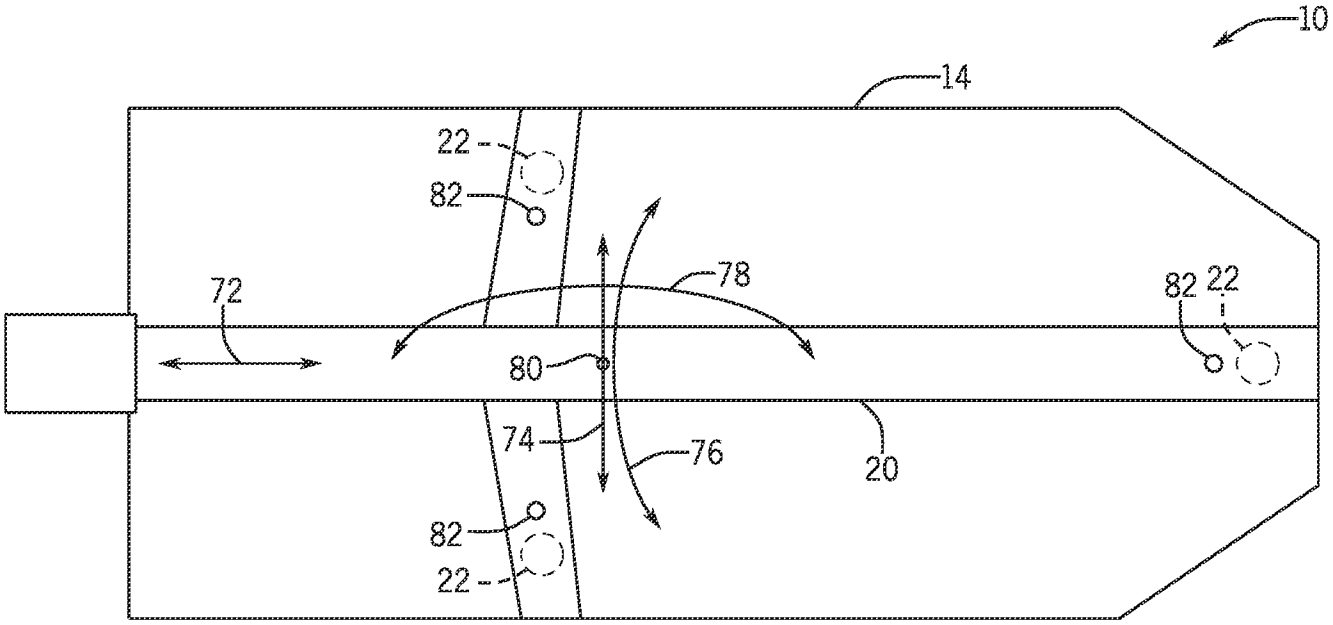
FIG. 5 is a schematic overhead view of the ride vehicle and the vehicle support with a triangular arrangement of extenders, in accordance with the present disclosure.

The ride vehicle 14 is configured to float when positioned in water, such as found in an aquatic portion (e.g., waterway) of a ride attraction. As noted above, this floatation is facilitated by the extenders 22, which allow a range of movement for the ride vehicle 14 relative to the vehicle support 20. The extenders 22 may function independently of each other in a purely mechanical manner, such as by responding to buoyant forces and gravity. In some embodiments, the extenders 22 may operate in dual modes (e.g., passive and active modes). In a passive mode, the extenders 22 may passively allow for motion caused by buoyant forces (e.g., while the ride vehicle 14 is in water) and, in an active mode, operate as a motion base to move the ride vehicle 14 with various degrees of freedom relative to the vehicle support 20. As presently recognized, these buoyant forces also facilitate efficient movement of the ride vehicle 14 in the active mode by counteracting at least a portion of a weight of the ride vehicle 14. As illustrated in FIGS. 2, 3 and 4, the extenders 22 may include various, different extender types and constructions with extended configurations 30 (e.g., greater than 50% extended) and retracted configurations 32 (e.g., greater than 50% retracted) of extender components 34 (e.g., piston arms and piston housings). The difference between the extended configuration 30 and the retracted configuration 32 may define a motion envelope in which adjustments can be made between the position of the vehicle support 20 and the ride vehicle 14 to accommodate buoyancy. As illustrated in FIG. 5 discussed below, the extenders 22 may be distributed relative to the ride vehicle 14 in a manner that allows rocking motion, such as side-to-side rocking and front-to-back rocking.

Turning to FIG. 2 in more detail, the extenders 22 are illustrated as pistons 38, in which the extender components 34 each include a piston arm 40 (e.g., extending portion) and a piston housing 41 (e.g., housing portion). The pistons 38 operate to transition between the extended configuration 30 and the retracted configuration 32 in a substantially linear manner. The piston arm 40 may be rigid or flexible and actuated using various types of power (e.g., electric, combustion-based, hydraulic). Further, each piston 38 may be actuated using any of various mechanisms 42 (e.g., winch, hydraulics, motor). For example, the pistons 38 may be fluidly-actuated (e.g., hydraulic pistons or gas-based pistons), ratcheted, or screw-actuated. In other embodiments, the pistons 38 may use other mechanisms (e.g., a winch) to expel and/or retract the piston arms 40, which may be flexible in such embodiments. For example, the pistons 38 may each include a winch in the piston housing 41 that extends or retracts the piston arm 40 relative to the piston housing 41. Regardless, the pistons 38 may operate to retract their piston arm 40 or otherwise secure the piston arm 40 to maintain the ride vehicle 14 in a substantially fixed configuration relative to the vehicle support 20.

In FIG. 3, the extenders 22 each include a base receptacle 44 (e.g., housing portion) and a connector insert 46 (e.g., extending portion) that cooperate to allow for guided transitioning between the extended configuration 30 and the retracted configuration 32. The base receptacle 44 of each extender 22 is shown connected to the vehicle support 20, and the corresponding connector insert 46 is coupled to the ride vehicle 14. The connector insert 46 of each extender 22 is shown as exploded away from the ride vehicle 14 to illustrate its geometry; however, line 47 is intended to represent coupling between the connector insert 46 and the ride vehicle 14. In the illustrated embodiment, the base receptacle 44 has a cylindrical geometry and the connector insert 46 has a conical geometry such that the geometries coordinate to facilitate early engagement therebetween and then guide the connector insert 46 into secured engagement with the base receptacle 44 when forced together. Other geometries (e.g., pyramidal and prismatic) are covered by present embodiments as well. The connector insert 46 may include a substantially rigid rod 48 or a substantially flexible cord 50 (e.g., a steel cable, a flexible cable) that allows for corresponding motion of the ride vehicle 14 relative to the vehicle support 20 when in the extended configuration 30. For example, additional range of motion may be provided by the flexible cord 50 (which may be retracted or expelled with a winch 51) relative to the rigid rod 48. However, both embodiments may provide for a range of motion in multiple directions (X, Y, and Z directions) when in the extended configuration 30. When the base receptacle 44 and the connector insert 46 are fully secured in the retracted configuration 32, the nature of their engagement may prevent any substantial relative motion between the ride vehicle 14 and the vehicle support 20. Indeed, as long as the connector insert 46 is retained in the base receptacle 44 along the Z direction (e.g., via tension on the flexible cord 50 provided by the winch 51), the receptacle may block movement in either of the X or Y directions.

As illustrated in FIG. 4, the extenders 22 may be coupled to the ride vehicle 14 via a hinged or flexible coupling 52 (e.g., ball and socket coupling, spherical bearing) to allow for different orientations of the ride vehicle 14 based on differing configurations of the various extenders 22 (e.g., the pistons 38). In some embodiments, a coupling 54 to the vehicle support 20 may also be hinged or flexible, such as a ball and socket coupling. Further, as schematically illustrated in FIG. 4, locking features 58 (e.g., automatic or actuatable locks) may be employed to fix the extenders 22 into desired orientations or configurations. For example, the locking features 58 may include hydraulic sealing mechanisms that retain the pistons 38 into the retracted configuration 32 or the extended configuration 30 by blocking flow of hydraulic fluid. As another example, the locking features 58 may include actuated rods that extend through the extender components (e.g., piston arm 40 and piston housing 41, or base receptacle 44 and connector insert 46) to secure the extenders 22 into desired configurations by physically blocking relative motion between the secured extender components 34. These locking features 58 may be monitored to confirm a locked or unlocked conditions. For example, the locking features 58 may communicate with a process controller to inform the process controller of a locked or unlocked status of the locking features 58, thereby enabling the process controller to continue, stop, or adjust ride functions based on received sensor data.

FIG. 5 is a schematic overhead view of the ride system 10, in accordance with an embodiment of the present disclosure. Specifically, FIG. 5 illustrates three extenders 22 coupled between the ride vehicle 14 and the vehicle support 20, at three locations and in a distributed arrangement, to counteract a moment of the ride vehicle 14. While some embodiments may provide more flexibility and/or more extenders 22 at more connection points, the illustrated embodiment limits moment about an X-axis 72 and a Y-axis 74 of the ride vehicle 14. However, some rocking motion is allowed to provide riders with a kinetic experience of floating in the ride vehicle 14. For example, by distributing the extenders 22 in the illustrated triangular configuration, a certain amount of side-to-side rocking, as represented by arrow 76 (e.g., about the X-axis 72), and front-to-back rocking, as represented by arrow 78 (e.g., about the Y-axis 74), and combinations thereof, are facilitated when the extenders 22 respond to buoyant forces and gravity by extending or retracting to varying lengths, such as linearly in parallel with a Z-axis 80. Moreover, it should be understood that the extenders 22 may be coupled between the ride vehicle 14 and the vehicle support 20 to enable any suitable ranges of motion therebetween. For example, Panhard rods or track bars may be utilized to provide three degrees of freedom, while Stewart platforms may be utilized to provide six degrees of freedom.

As further illustrated in FIG. 5, actuators 82 that are separate from the extenders 22 may be employed as a controllable motion base when it is desirable to actively move the ride vehicle 14 relative to the vehicle support 20. These actuators 82 may completely decouple from the ride vehicle 14 when not in operation so that they do not interfere with passive effects allowed by the extenders 22, such as when the ride vehicle 14 is floating in water. Further, as previously noted, the extenders 22 may operate as both active actuators and passive securement mechanisms in certain embodiments. In embodiments where the extenders 22 are operable to actively manipulate the relative positioning of the ride vehicle 14 with respect to the vehicle support 20, the additional actuators 82 may be excluded or included for additional functionality.

Figure 6:
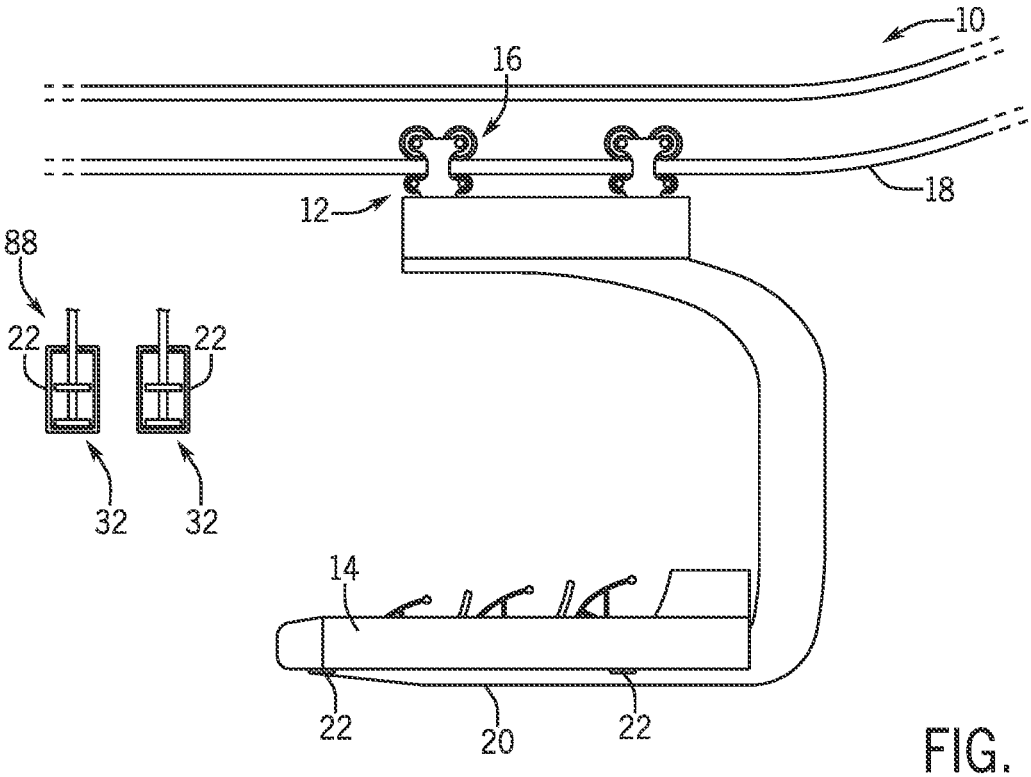
FIG. 6 is a side view of a bogie holding the ride vehicle in a suspended configuration, wherein the extenders are in a retracted configuration, in accordance with the present disclosure.
Figure 7:
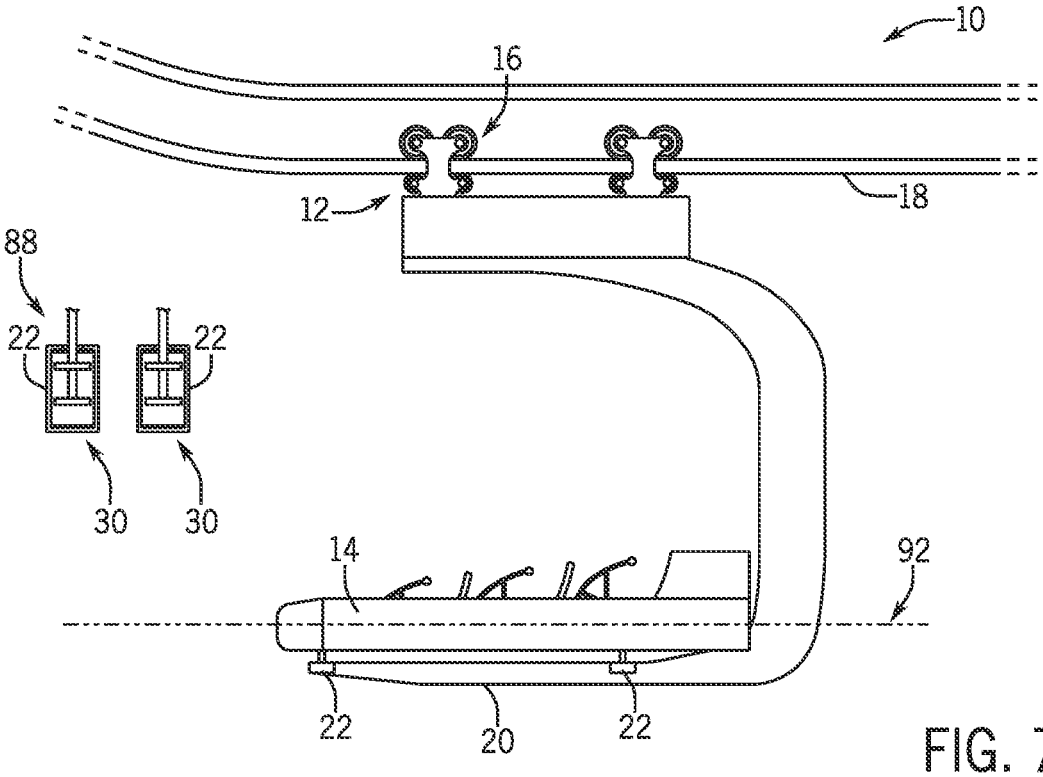
FIG. 7 is a side view of the bogie with the ride vehicle positioned in an aquatic portion of the ride and submersed to a point where the extenders are fully extended, in accordance with the present disclosure.
Figure 8:
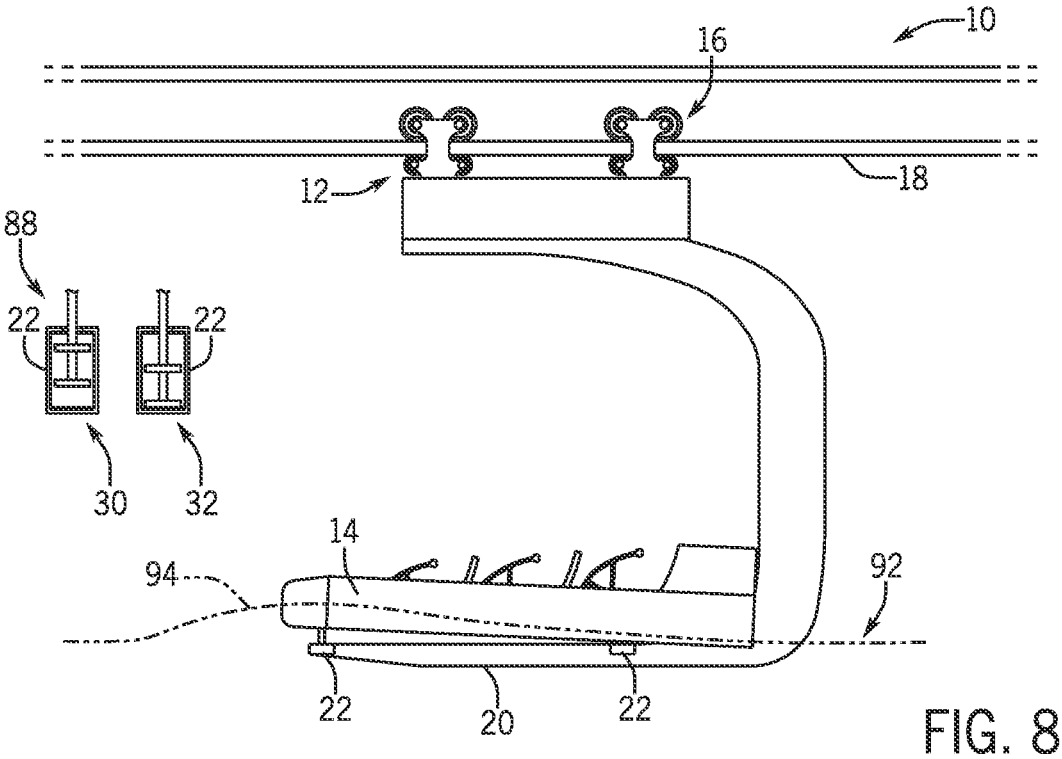
FIG. 8 is a side view of the bogie with the ride vehicle positioned in the aquatic portion of the ride and in a buoyant mode of operation, in accordance with the present disclosure.

FIGS. 6, 7, and 8 include side views of the ride system 10 during different phases of operation, including operation with the ride vehicle 14 as a suspended ride vehicle (FIG. 6), operation while the ride vehicle 14 is partially submerged (e.g., submersed) and with the extenders 22 fully extended (FIG. 7), and operation with the ride vehicle 14 in a buoyant mode (FIG. 8). Further, FIGS. 6, 7, and 8 each include representations of extender operations 88, which are illustrative of a condition of the extenders 22 during the respective modes of operation of the ride system 10. The representations of the extender operations 88 are illustrated as pistons in extended configurations 30 and retracted configurations 32. These representations of the extender operations 88 are intended to generally reflect the nature of the extender operations during various portions of a ride. However, these operations are not limiting and can include any of numerous variations, in accordance with the present disclosure. For example, during operation of the ride vehicle 14 as a suspended ride vehicle (FIG. 6), the extenders 22 could be locked into an extended configuration 30 instead of the illustrated retracted configuration 32.

The bogie 12 may carry the ride vehicle 14 along the track 18 between the various phases of operation illustrated in FIGS. 6, 7, and 8. As noted above, FIG. 6 illustrates the ride system 10 operating with the ride vehicle 14 suspended, such as during an aerial portion of a ride. In this mode of operation, the representation of the extender operation 88 shows that the extenders 22 are each in the retracted configuration 32. This configuration may occur as a natural result of the bogie 12 lifting the ride vehicle 14 out of the water such that buoyancy forces no longer push the ride vehicle 14 away from the vehicle support 20. Thus, gravity pushes the ride vehicle 14 toward the vehicle support 20 and causes the extenders 22 to collapse into the retracted configuration 32. As previously noted, geometric and/or structural aspects of the extender components 34 may facilitate and cause this natural joinder between the extender components 34 in the retracted configuration 32. For example, the rigid piston arm 40 may be forced into the piston housing 41 by gravity. However, in an embodiment, the extenders 22 may also be actuated (e.g., winched, ratcheted, hydraulically pulled) into the retracted configuration 32. Further, as previously noted, the extenders 22 (or other actuators 82) may be configured to actuate (e.g., between the extended and the retracted configurations 30, 32) such that the ride vehicle 14 can be operated to pitch, yaw, and roll. In another embodiment, the ride vehicle 14 is configured to pitch, yaw, and roll due to actuators extending between a main body of the bogie 12 and the vehicle support 20. Further still, aspects of the motion of the ride vehicle 14 (e.g., the pitch and roll) may be controlled by the orientation of the track 18. For example, the track 18 may cause the entire bogie 12, along with the ride vehicle 14, to pitch and roll in response to the orientation and curvature of the track 18.

FIG. 7 illustrates the bogie 12 and the track 18 positioning the ride vehicle 14 in a submersed or partially submerged position within a waterway 92 of a ride. Specifically, the bogie 12 and the track 18 are positioned with respect to the waterway 92 such that the ride vehicle 14 is submersed to a level that corresponds to the extenders 22 being in the extended configuration 30, with a maximum amount of extension. Thus, the representation of the extender operation 88 in FIG. 7 shows the extenders 22 both fully extended. It should be noted that this condition may occur when the ride vehicle 14 is only partially submersed and when the extenders 22 are submerged. However, in other embodiments, the extenders 22 may be configured such that maximum extension of the extenders 22 does not occur unless the ride vehicle 14 is fully submersed or freely floating by nature of its own buoyancy. Relative to the illustrated embodiment, such embodiments provide for a larger range of operation in which the ride vehicle 14 can float and respond naturally to buoyancy forces.

FIG. 8 illustrates the bogie 12 and the track 18 positioning the ride vehicle 14 in a buoyant mode of operation within the waterway 92 of the ride. Specifically, the bogie and the track are positioned with respect to the waterway 92 such that the ride vehicle is submersed to a level that corresponds to a range of motion between the extenders 22 being fully extended in the extended configuration 30 and fully retracted in the retracted configuration 32. To reflect this positioning, the representation of extender operation 88 shows one extender 22 fully extended in the extended configuration 30 and one extender 22 fully retracted in the retracted configuration 32. Further, as illustrated in FIG. 8, the waterway 92 is represented as varying in depth. For example, a wave 94 is illustrated as causing a discrepancy in the configuration of the extenders 22 based on associated buoyancy forces on the ride vehicle 14. Thus, the extenders 22 are illustrated as providing motion that correlates to the changes in the waterway 92 such that riders will experience a more authentic and immersive floating experience.

Figure 9:
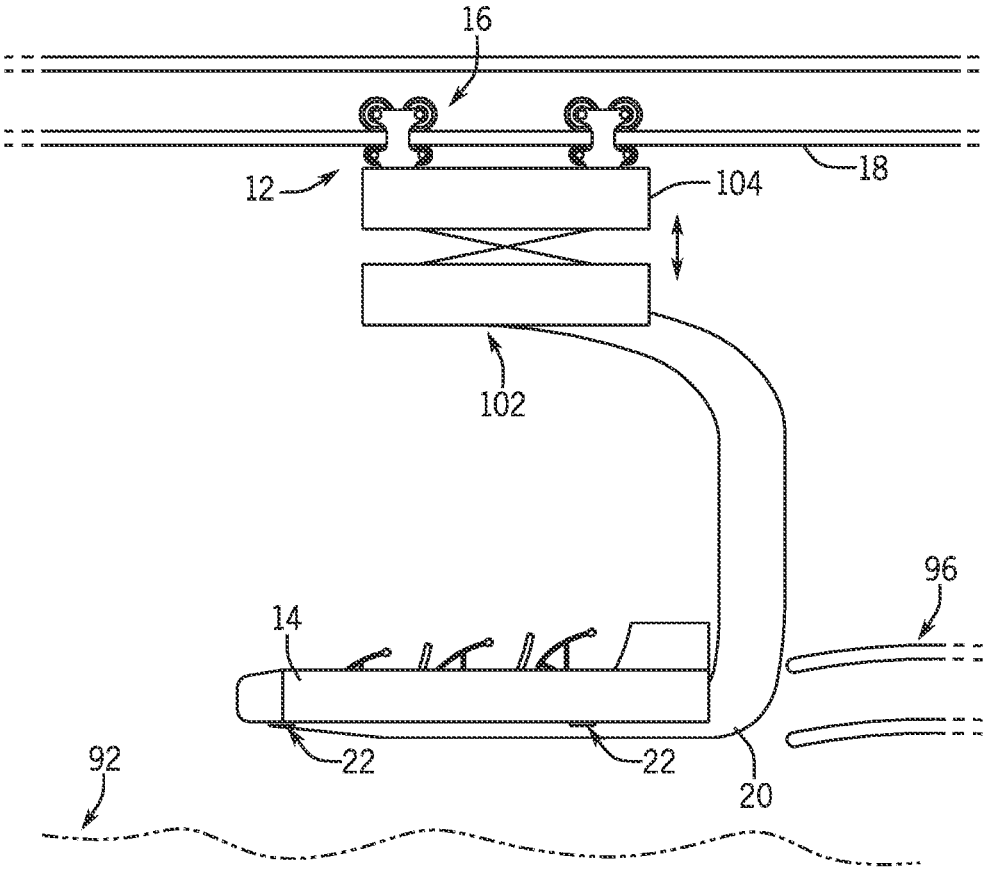
FIG. 9 is a side view of the bogie with the ride vehicle in a suspended mode of operation, wherein the bogie includes a motion platform, in accordance with the present disclosure.

Each of FIGS. 6, 7, and 8 illustrate the bogie 12 as including the vehicle support 20 as a rigid and integral part of the bogie 12. While some additional positioning may be performed using actuatable extenders 22, in such embodiments, positioning of the ride vehicle 14 with respect to the waterway 92 is primarily based on the positioning of the bogie 12 on the track 18. However, FIG. 9 illustrates an embodiment of the bogie 12 including a motion platform 102 between a main body 104 of the bogie 12 and the vehicle support 20. Specifically, the motion platform 102 is represented as a Stewart platform that can be used to move the ride vehicle 14 with multiple degrees of freedom. In such an embodiment, the motion platform 102 can also operate to position the ride vehicle 14 relative to the waterway 92 or other ride features, such as false tracks 96. For example, the motion platform 102 can be actuated to lower the ride vehicle 14 into the waterway 92 to a point where the ride vehicle 14 is floating and the extenders 22 are operational within a range that allows for buoyancy forces of the water in the waterway 92 on the ride vehicle 14 to be experienced by riders. Further, the motion platform 102 can move the ride vehicle relative to the false tracks 96 to give the impression of engaging with and then falling off of the false tracks 96. Moreover, although illustrated with the motion platform 102 between the bogie 12 and the vehicle support 20, it should be understood that certain embodiments may alternatively or additionally utilize a suitable configuration of the extenders 22 as a motion base, such as the Stewart platform, between the ride vehicle 14 and the vehicle support 20. Indeed, by coupling six extenders 22 between the ride vehicle 14 and the vehicle support 20, the ride vehicle 14 may experience increased degrees of freedom when moving in water to further immerse riders within the ride.

Figure 10:
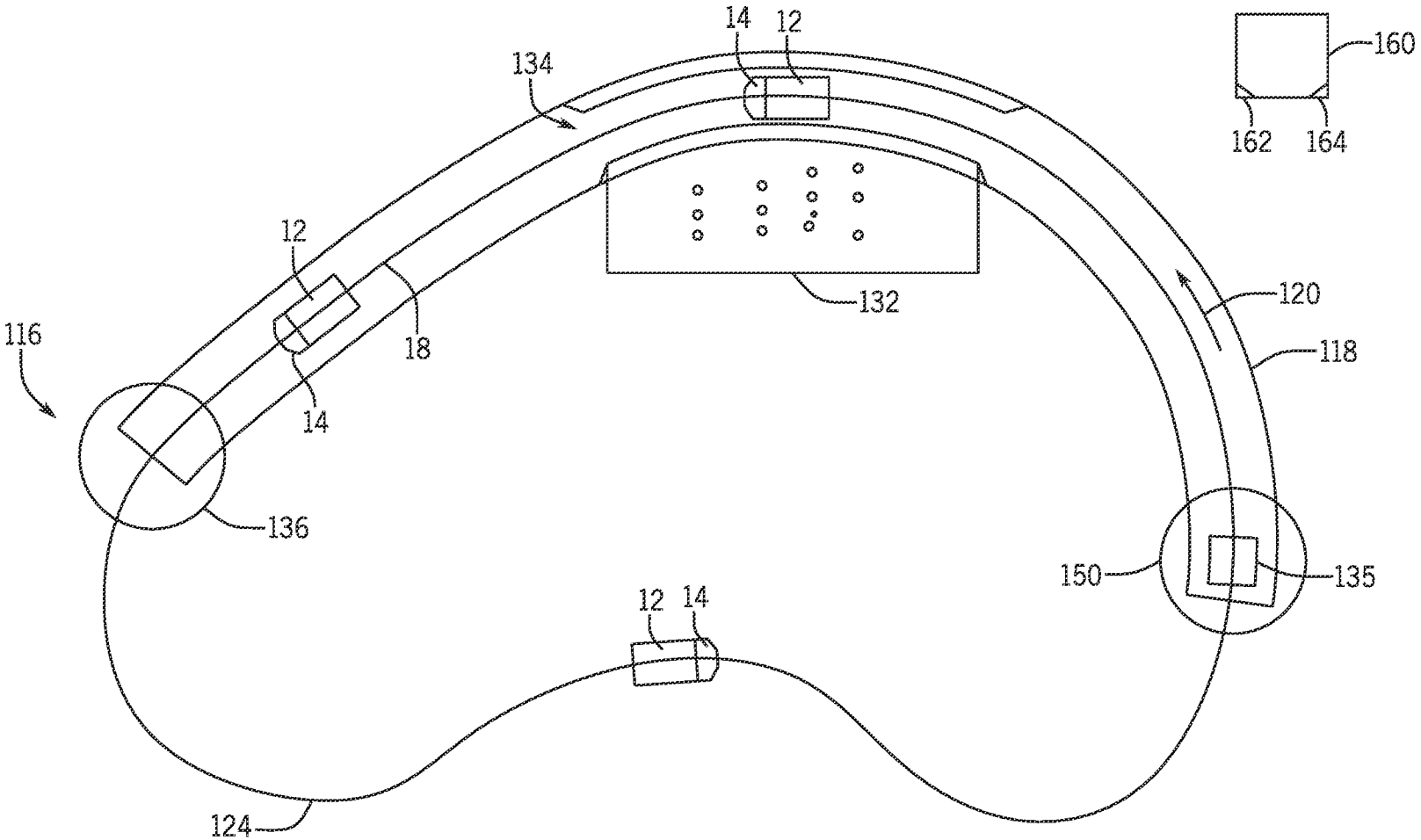
FIG. 10 is a schematic representation of the ride system including a ride path with aerial and aquatic portions, in accordance with the present disclosure.

With the foregoing in mind, FIG. 10 illustrates the ride system 10 (e.g., amusement park attraction) including multiple ride vehicles 14 configured to move along a path 116 of the ride system 10. The path 116 includes an aquatic portion 118 having a flow path 120 (e.g., defined by a flume). The path 116 also includes an aerial portion 124. Both the aquatic portion 118 and the aerial portion 124 include the track 18, which supports the bogie 12. As discussed herein, the ride vehicles 14 are configured to float along the aquatic portion 118, while in dynamic engagement with the bogie 12 via the extenders 22, and to be lifted and carried by the bogie 12 along the aerial portion 124, with the extenders 22 in a secured (e.g., retracted, locked) configuration. As the ride vehicles 14 travel along the path 116, the ride vehicles 14 may be subjected to various thematic effects, such as animatronic show pieces, special effects, and so forth. Some of these thematic effects may be employed to disguise the nature of the bogie 12 and the maintained contact between the ride vehicles 14 and the respective bogies 12 throughout the ride. In other words, special effects and camouflage may be used to make the ride vehicles 14 seem to be simple boats that do not operate based on interactions with the bogies 12.

At the start of a ride cycle, riders may board or disembark the ride vehicle 14 from a boarding platform 132. In some embodiments, while the riders board/disembark the ride vehicle 14 from the boarding platform 132, the ride vehicle 14 may be transitioned through a shoot 134 disposed adjacent to the boarding platform 132. The shoot 134 may narrowly allow passage of the ride vehicle 14 to facilitate transitioning of riders into and out of the ride vehicle 14. The shoot 134 may be filled with water to provide the feel of a boat ride, and the vehicle support 20 extending from the bogie 12 may be camouflaged to limit identification by riders of the nature of the interface between the bogie 12 and the ride vehicle 14 during this phase of the ride. In some embodiments, the bogies 12 may move the ride vehicles 14 in front of the boarding platform 132 at a consistent speed and elevation to allow riders to easily board the ride vehicles 14. This may include locking the extenders 22 into a position (e.g., the retracted configuration 32) that secures the ride vehicle 14 relative to the bogie 12. In some embodiments, the bogies 12 may cause the ride vehicles 14 to momentarily stop in front of the boarding platform 132 to allow the riders to board the ride vehicles 14. In some embodiments, portions of the vehicle supports 20 (including the extenders 22) may be partially submerged or completely submerged under water of the flow path 120.

Once the riders have boarded the ride vehicle 14, the bogies 12 may transition the ride vehicles 14 into a state of partial submersion in the water of the aquatic portion 118 (e.g., FIG. 8). The ride vehicle 14 may then become buoyant as the extenders 22 are released or become active along the length of the aquatic portion 118. Specifically, for example, pistons operating as the extenders 22 and coupling the ride vehicle 14 to the vehicle support 20 of the bogie 12 may be allowed to extend and retract as the ride vehicle 14 experiences the buoyant forces of the water in the aquatic portion 118. Additionally, the bogie 12 may coordinate with measured current values in the aquatic portion 118 to provide riders with the illusion that the ride vehicle 14 is being pulled along by the current in the aquatic portion 118 alone. For example, the water current may be generated by a mechanical propulsion system 135, such as water jets or propellers disposed along the flow path 120. The current may be measured by sensors of the mechanical propulsion system 135 or other sensors and used (e.g., via an attraction controller 160) to manage a speed of the bogies 12 along the path 116. While illustrated at a particular point along the path 116, it is to be understood that the mechanical propulsion system 135 may be disposed throughout the aquatic portion 118 of the path 116. However, the motion of the ride vehicle 14 while in the aquatic portion 118 may be a result of the speed of the bogie 12 and systems such as the mechanical propulsion system 135 may be excluded. Despite being motivated by the bogie 12 (either in coordination with the mechanical propulsion system 135 or alone), present embodiments may provide the feel of an actual boat because the extenders 22 allow for action of the ride vehicle 14 based on buoyancy. Indeed, unlike traditional pseudo water-based rides where a track is present under water, present embodiments include the ride vehicle 14 being supported by its natural buoyancy in the water, as the extenders 22 adjust to the buoyancy while maintaining ultimate engagement with the bogie 12 within the aquatic portion 118.

The ride vehicle 14 may generally travel along at least a portion of the flow path 120 with a front of the ride vehicle 14 generally facing in the downstream direction of the flow path 120, but varying orientations are contemplated by the present disclosure. In certain embodiments, the ride vehicle 14 may be swayed (e.g., yawed) to some degree while traveling along the flow path 120 by the bogie 12 (e.g., the motion platform 102 of the bogie 12, such as a Stewart platform) or based on the positioning of the track 18. Various configurations of the track 18 or operation of the bogie 12 may be coordinated with the flow path 120 to provide a realistic impression of floating and being guided by the water in the flow path 120 alone. The bogie 12 is configured to rise up relative to the ride vehicle 14, and, thus, more directly engage the ride vehicle 14 (e.g., via collapsing the extenders 22) after the ride vehicle 14 has travelled the length of the aquatic portion 118 and has arrived at a transition location 136. The transition to the aerial portion 124 may include locking the ride vehicle 14 to the bogie 12. In some cases, this locking may include actuating features of the extenders 22 (e.g., hydraulics) to retain the extenders 22 in place (e.g., in a retracted configuration). As the ride vehicle 14 is carried along the track 18 of the aerial portion 124 by the bogie 12, the bogie 12 and the track 18 are configured to cooperatively pitch, yaw, and roll the ride vehicle 14.

After the bogie 12 and the ride vehicle 14 have traveled the length of the aerial portion 124, the bogie 12 may place the ride vehicle 14 in the aquatic portion 118 of the path 116 and disengage any locked engagement between the bogie 12 and the ride vehicle 14 to allow the extenders 22 to operate and again allow for motion based on the buoyant forces between the ride vehicle 14 and the water of the aquatic portion 118. Particularly, as shown, the bogie 12 may place the ride vehicle 14 at an origin 150 of the aquatic portion 118 such that the ride vehicle 14 is headed downstream along the flow path 120.

As discussed herein, operations of the ride system 10 may be controlled utilizing a controller 160 (e.g., attraction controller, ride controller). The controller 160 may be any device employing a processor 162 (which may represent one or more processors), such as an application-specific processor. The controller 160 may also include a memory device 164 storing instructions executable by the processor 162 to perform methods and control actions described herein relating to the ride system 10. The processor 162 may include one or more processing devices, and the memory device 164 may include one or more tangible, non-transitory, machine-readable media. By way of example, such machine-readable media can include RAM, ROM, EPROM, EEPROM, CD-ROM, or other optical disk storage, magnetic disk storage or other magnetic storage devices, or any other medium which can be used to carry or store desired program code in the form of machine-executable instructions or data structures and which can be accessed by the processor 162 or by any general purpose or special purpose computer or other machine with a processor. For example, the attraction controller 160 may be utilized to ensure locked engagement of the vehicle support 20 to the ride vehicle 14, ensure operation of the extenders 22 to allow movement of the ride vehicle 14 relative to the bogie 12 due to buoyancy, determine orientation of the ride vehicle 14 as the ride vehicle 14 travels along the track 18, and/or control speed of the ride vehicle 14 (e.g., by controlling the bogie 12 based on flow rate of water in the aquatic portion 118). The attraction controller 160 may also monitor and control aspects relating to timing of the movement of the ride vehicles 14 as the ride vehicles 14 progress through the ride system 10.

While only certain embodiments have been illustrated and described herein, many modifications and changes will occur to those skilled in the art. It is, therefore, to be understood that the appended claims are intended to cover all such modifications and changes as fall within the true spirit of the disclosure. It should be appreciated that any of the features illustrated or described with respect to the figures discussed above may be combined in any suitable manner.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . " it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A ride system, comprising:

a ride vehicle comprising a buoyant material configured to float in a liquid;

a bogie configured to travel along a track;

a vehicle support coupled to the bogie, wherein the ride vehicle is disposed between the vehicle support and the track; and a plurality of extenders coupled to the vehicle support and coupled to the ride vehicle, wherein the plurality of extenders is configured to transition between a retracted configuration that retains the vehicle proximate to the vehicle support and an extended configuration that allows the ride vehicle to float in the liquid within a range of motion relative to the vehicle support, wherein a first amount of the plurality of extenders are on a first side of the ride vehicle, wherein a second amount of the plurality of extenders are on a second side of the ride vehicle, and wherein the first amount is different than the second amount.

2. The ride system of claim 1, wherein each extender of the plurality of extenders is individually operable to transition between respective retracted configurations and extended configurations.

3. The ride system of claim 1, wherein an extender of the plurality of extenders comprises a piston, which comprises a piston arm configured to transition out of a piston housing as the piston transitions from the retracted configuration to the extended configuration.

4. The ride system of claim 1, wherein an extender of the plurality of extenders comprises a connector insert and a base receptacle, and wherein the connector insert is configured to extend into the base receptacle when the extender is in the retracted configuration.

5. The ride system of claim 4, comprising a flexible cable or a rigid rod moveably coupling a body of the connector insert to the base receptacle.

6. The ride system of claim 4, wherein the connector insert is coupled to the vehicle support and the base receptacle is coupled to the ride vehicle.

7. The ride system of claim 1, wherein the plurality of extenders is coupled to the vehicle support and the ride vehicle in a triangular arrangement, and wherein each extender of the plurality of extenders is individually operable to transition between respective retracted configurations and extended configurations such that the ride vehicle is moveable side-to-side and forward-to-backward.

8. The ride system of claim 1, comprising one or more actuators wherein the plurality of extenders is configured to be actuated by the one or more actuators.

9. The ride system of claim 1, wherein an extender of the plurality of extenders comprises an extending portion and a housing portion, and wherein the extending portion is configured to be retracted into the housing portion via a winch.

10. The ride system of claim 1, wherein an extender of the plurality of extenders comprises a piston arm and a piston housing, and wherein a position of the piston arm relative to the piston housing is configured to be adjusted via hydraulics.

11. The ride system of claim 1, wherein the first side of the ride vehicle comprises a front portion of the ride vehicle, and wherein the second side of the ride vehicle comprises a back portion of the ride vehicle.

12. A ride system, comprising:

a ride path including a suspended portion and an aquatic portion;

a track extending along the ride path;

a bogie configured to engage with and travel along the track;

a ride vehicle positioned under the track and configured to transport riders;

a vehicle support of the bogie positioned under the ride vehicle and configured to support the ride vehicle through the suspended portion of the ride path; and a plurality of extenders coupling the ride vehicle to the vehicle support, wherein the plurality of extenders is configured to retract and secure the ride vehicle to the vehicle support through the suspended portion of the ride path, and wherein the plurality of extenders is configured to extend and retract in response to buoyancy of the ride vehicle positioned within a liquid through the aquatic portion of the ride path, wherein a first amount of the plurality of extenders are on a first side of the ride vehicle, wherein a second amount of the plurality of extenders are on a second side of the ride vehicle, and wherein the first amount is different than the second amount.

13. The ride system of claim 12, wherein the bogie comprises a motion base configured to raise and lower the vehicle support relative to the track.

14. The ride system of claim 12, wherein the plurality of extenders is configured to passively allow transitioning between respective extended configurations and respective retracted configurations.

15. The ride system of claim 12, comprising a plurality of actuators, wherein the plurality of extenders is configured to be actuated into respective extended configurations and respective retracted configurations by the plurality of actuators.

16. The ride system of claim 12, comprising a locking feature configured to secure an extender of the plurality of extenders into a fixed configuration.

17. The ride system of claim 12, wherein an extender of the plurality of extenders comprises a piston, which includes a piston arm configured to transition into and out of a piston housing.

18. A method of ride system operation, the method comprising:

positioning a ride vehicle into a body of a liquid using a bogie, wherein the bogie is coupled to a track via a wheel assembly and configured to travel along the track, and the bogie is coupled to the ride vehicle via a ride vehicle support, which is coupled to the ride vehicle via a plurality of extenders, wherein a first amount of the plurality of extenders are on a first side of the ride vehicle, wherein a second amount of the plurality of extenders are on a second side of the ride vehicle, and wherein the first amount is different than the second amount;

transitioning at least one extender of the plurality of extenders from a retracted configuration to an extended configuration as the ride vehicle becomes buoyant in the liquid; and allowing the ride vehicle to move within a motion envelope defined by the retracted configuration and the extended configuration as the ride vehicle experiences buoyant forces in the liquid, wherein the extended configuration positions the ride vehicle closer to the track and the wheel assembly as compared to the retracted configuration.

19. The method of ride system operation of claim 18, comprising lifting the ride vehicle out of the liquid by moving the bogie.

20. The method of ride system operation of claim 19, wherein lifting the ride vehicle causes the at least one extender of the plurality of extenders to transition to a fully retracted configuration.

* * * * *